United States Patent [19]

Whittaker et al.

[11] Patent Number: 4,632,054

[45] Date of Patent: Dec. 30, 1986

[54] DEVELOPMENT SYSTEM

[75] Inventors: Gary L. Whittaker, Penfield; Mort Silverberg, Rochester, both of N.Y.

[73] Assignee: Xerox Corporation, Stamford, Conn.

[21] Appl. No.: 732,336

[22] Filed: May 10, 1985

[51] Int. Cl.[4] ..... G03G 15/06

[52] U.S. Cl. ..... 118/657

[58] Field of Search ..... 118/657, 658

[56] References Cited

U.S. PATENT DOCUMENTS

| | | | |
|---|---|---|---|
| 4,098,228 | 7/1978 | Ruckdeschel et al. | 118/658 |
| 4,267,797 | 5/1981 | Huggins | 118/658 |
| 4,292,921 | 10/1981 | Kroll et al. | 118/657 X |
| 4,297,972 | 11/1981 | Hwa | 118/658 |

OTHER PUBLICATIONS

Research Disclosure Journal, Apr. 1978, p. 4, No. 16823, disclosed by Paxton.

*Primary Examiner*—Bernard D. Pianalto

*Attorney, Agent, or Firm*—H. Fleischer; J. E. Beck; R. Zibelli

[57] ABSTRACT

An apparatus which develops a latent image by transporting marking particles into contact therewith at least two successive times. An operator adjustable voltage source is coupled to the marking particle transport to electrically bias the transport to at least either a first electrical potential optimizing development of solid areas with the marking particles during the first contact time or to a second electrical potential suppressing development of solid areas. The transporting means is electrically biased to an electrical potential substantially optimizing development of lines with the marking particles during the second contact time.

12 Claims, 2 Drawing Figures

DEVELOPMENT SYSTEM

This invention relates generally to an electrophotographic printing machine, and more particularly concerns an apparatus for developing a latent image.

In general, electrophotographic printing requires the utilization of a photoconductive member which is charged to a substantially uniform potential so as to sensitize the surface thereof. The charged portion of the photoconductive surface is exposed to a light image of an original document being reproduced. This records an electrostatic latent image on the photoconductive surface corresponding to the informational areas contained within the original document. After the electrostatic latent image is recorded on the photoconductive surface, the latent image is developed by bringing a developer material into contact therewith. This forms a powder image on the photoconductive surface which is subsequently transferred to a copy sheet. Finally, the copy sheet is heated to permanently fuse the powder image thereto in image configuration.

Frequently, the developer material comprises toner particles adhering triboelectrically to carrier granules. This two component mixture is brought into contact with the latent image. The toner particles are attracted from the carrier granules to the latent image forming a powder image thereof. Hereinbefore, it has been difficult to develop both large solid areas of the latent image uniformly and the low density lines thereof. Different techniques have generally been utilized to improve solid area development. For example, a development electrode is frequently employed to improve solid area development. This approach is used in conjunction with multi-roller magnetic brush development systems. It is also advantageous to be capable of selectively suppressing solid area development. By suppressing solid area development while still developing lines and dots, background is reduced. Halftones are improved by reducing fill-in shadow regions. In addition, high density, high contrast solid area development could be utilized for additional copying modes. Thus, it is desirable to be capable of selectively enhancing or suppressing development of solid areas.

Various approaches have been devised to improve development.

The following disclosures appear to be relevant:

U.S. Pat. No. 4,098,228; Patentee: Ruckdeschel et al.; Issued: July 4, 1978.

U.S. Pat. No. 4,267,797; Patentee: Huggins; Issued: May 19, 1981.

U.S. Pat. No. 4,297,972; Patentee: Hwa; Issued: Nov. 3, 1981.

Research Disclosure Journal, April 1978; Page 4, No. 16823; Disclosed by: Paxton.

The relevant portions of the foregoing disclosures may be briefly summarized as follows:

Ruckdeschel et al. discloses an electrophotographic printing machine employing a high speed magnetic brush development system. The development system utilizes a plurlity of developer rollers. The developer rollers are spaced different distances from the photoconductive surface. The roller closest to the photoconductive surface rotates at a higher tangential velocity than the roller further away from the photoconductive surface.

Huggins discloses a multi-roll magnetic brush development system in which the first magnetic brush developer roller interacts with the developer composition causing the developer material to have a higher conductivity than the conductivity of the developer material in the region of the second magnetic brush developer roller. The first magnetic brush developer roller is closer to the photoconductive surface than the second magnetic brush developer roller. The solid areas of the latent images are developed with a higher conductivity developer material with lines being developed with a lower conductivity developer material.

Hwa discloses a development system wherein the first developer roller is spaced more closely to the photoconductive surface than the second developer roller. The first developer roller has a stronger magnetic field than the second developer roller. In this way, the first developer roller optimizes development of solid areas with the second developer roller optimizing development of lines within the electrostatic latent image.

Paxton describes a magnetic brush in which the conductivity of the developer material in the nip between the brush and photoconductor is adjusted by varying the amount or density of the developer material in the nip. To provide improved copy contrast, fringiness between solid area and line development, the amount of developer material in the nip can be selectively adjusted. Alternatively, the electrical bias applied to the magnetic brush may also be selectively adjusted.

In accordance with the present invention, there is provided on apparatus for developing a latent image. The apparatus includes means for transporting marking particles into contact with the latent image at least two successive times. Operater adjustable means, coupled to the transporting means, electrically bias the transporting means to at least either a first electrical potential substantially optimizing development of solid areas with the marking particles during the first contact time or to a second electrical potential substantially suppressing development of solid areas with the marking particles during the first contact time. Means, coupled to the transporting means, electrically bias the transporting means to an electrical potential substantially optimizing development of lines within the marking particles during the second contact time.

Pursuant to another aspect of the features of the present invention, there is provided an electrophotographic printing machine of the type having an electrostatic latent image recorded on a photoconductive member. Means transport marking particles into contact with the electrostatic latent image recorded on the photoconductive member at least two successive times. Operator adjustable means, coupled to the transporting means, electrically bias the transporting means to at least either a first electrical potential substantially optimizing solid area development or to a second electrical potential substantially suppressing solid area development. Means, coupled to the transporting means, electrically bias the transporting means to an electrical potential substantially optimizing development of lines with marking particles during the second contact time.

Other aspects of the present invention will become apparent as the following description proceeds and upon reference to the drawings, in which:

DESCRIPTION OF THE REFERENCES

FIG. 1 is a schematic elevational view depicting an electrophotographic printing machine incorporating the features of the present invention therein; and FIG. 2 is a schematic elevational view showing the development system employed in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following description that this development apparatus is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

DETAILED DESCRIPTION OF THE REFERENCES

Figure 1:
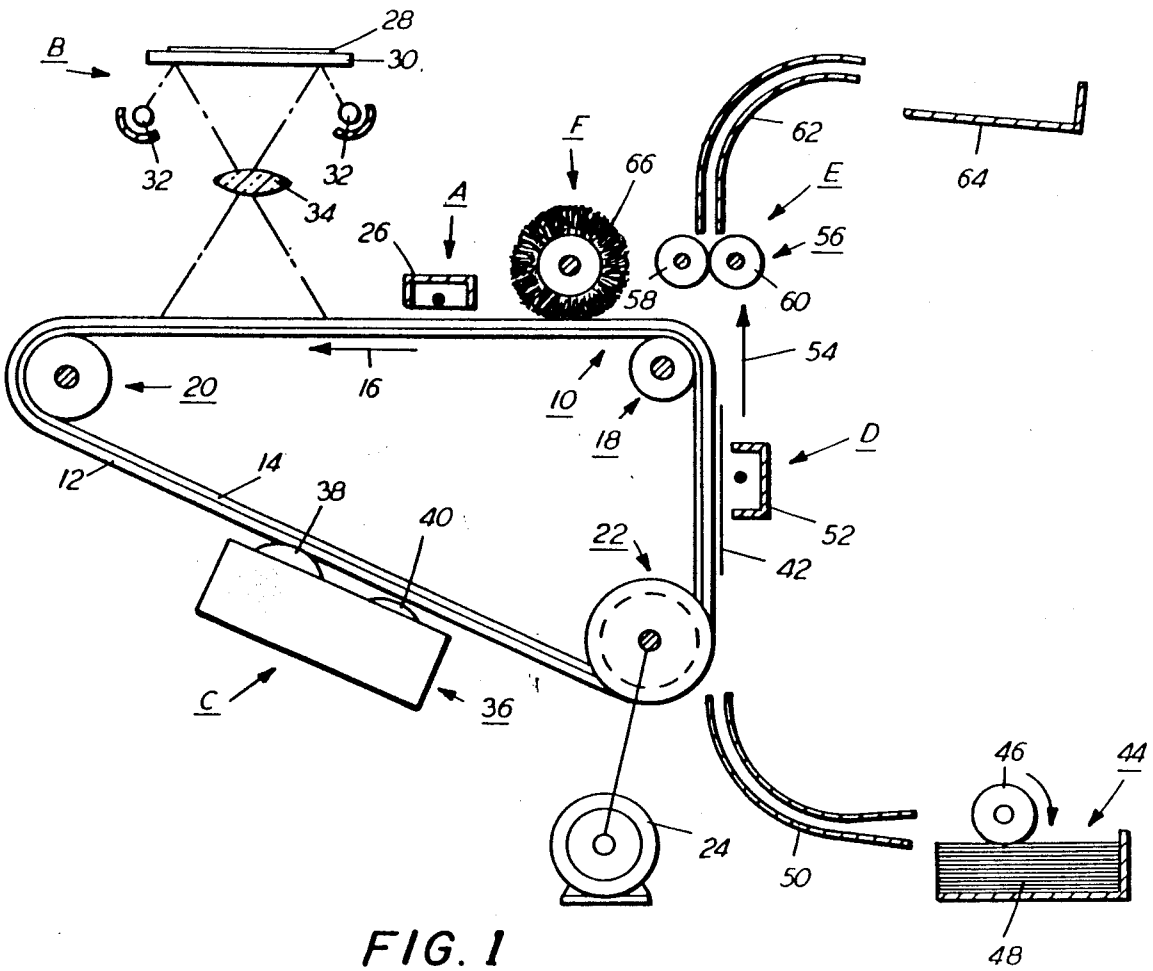

As shown in FIG. 1, the electrophotographic printing machine employs a belt 10 having a photoconductive surface 12 deposited on a conductive substrate 14. Preferably, photoconductive surface 12 comprises a transport layer containing small molecules of m-TBD dispersed in a polycarbonate and a generation layer of trigonal selenium. Conductive substrate 14 is made preferably from aluminized mylar which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tension roller 20, and driver roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive. Drive roller 22 includes a pair of opposed, spaced edge guides. The edge guides define a space therebetween which determines the desired path of movement for belt 10. Belt 10 is maintained in tension by a pair of springs (not shown) resiliently urging tension roller 22 against belt 10 with the desired spring force. Both stripping roller 18 and tension roller 20 are mounted to rotate freely.

Initially, a portion of belt 10 passes through charging station A. At charging station A, a corona generating device, indicated generally by the preference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face down upon a transparent platen 30. Lamps 32 flash light rays onto original document 28. The light rays deflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the information areas contained within original document 28.

Thereafter, belt 10 advances the electrostatic latent image recorded on photoconductive surface 12 to development station C. At development station C, a magnetic brush development system, indicated generally by the reference numeral 36, advances an insulative developer material into contact with the electrostatic latent image. Preferably, magnetic brush development system 36 includes two magnetic brush developer rollers 38 and 40. These rollers each advance developer material into contact with the latent image. Each developer roller forms a brush comprising carrier granules and toner particles. The latent image attracts the toner particles from the carrier granules forming a toner powder image on photoconductive surface 12 of belt 10. Developer roller 38 transports the developer material into contact with the latent image the first time with developer roller 40 transporting the developer roll into contact with the latent image the last or second time. Developer rollers 38 and 40 are mounted on brackets which include slots therein. These slots permit the developer rollers to be moved toward and away from belt 10. In this way, each developer roller may be positioned a discrete distance from belt 10 and locked in position. Other suitable adjustment means may be employed to locate each developer roller in the desired position with respect to photoconductive surface 12. The detailed structure of magnetic brush system 36 will be described hereinafter with reference to FIG. 2.

After development, belt 10 advances the toner powder image to transfer station D. At transfer station D, a sheet of support material 42 is moved into contact with the toner powder image. The sheet of support material is advanced to transfer station D by a sheet feeding apparatus 44. Preferably, sheet feeding apparatus 44 includes a feed roll 46 contacting the uppermost sheet of stack 48. Feed roll 46 rotates so as to advance the uppermost sheet from stack 48 into chute 50. Chute 50 directs the advancing sheet of support material into contact with photoconductive surface 12 of belt 10 in a timed sequence so that the toner powder image developed thereon contacts the advancing sheet of support material at transfer station D.

Transfer station D includes a corona generating device 52 which sprays ions onto the back side of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred powder image to sheet 42. Preferably, fuser assembly 56 includes a heated fuser roller 58 and a back-up roller 60. Sheet 42 passes between fuser roller 58 and back-up roller 60 with the toner powder image contacting fuser roller 58. In this manner, the toner powder image is permanently affixed to sheet 42. After fusing, chute 62 guides the advancing sheet 42 to catch tray 64 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a rotatably mounted fiberous brush 66 in contact with photoconductive surface 12. The particles are cleaned from photoconductive surface 12 by the rotation of brush 66 in contact therewith. Subsequent to cleaning, a discharge lamp (not shown) floods photoconductive surface 12 with light to dissipate any residual electrostatic charge reamining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
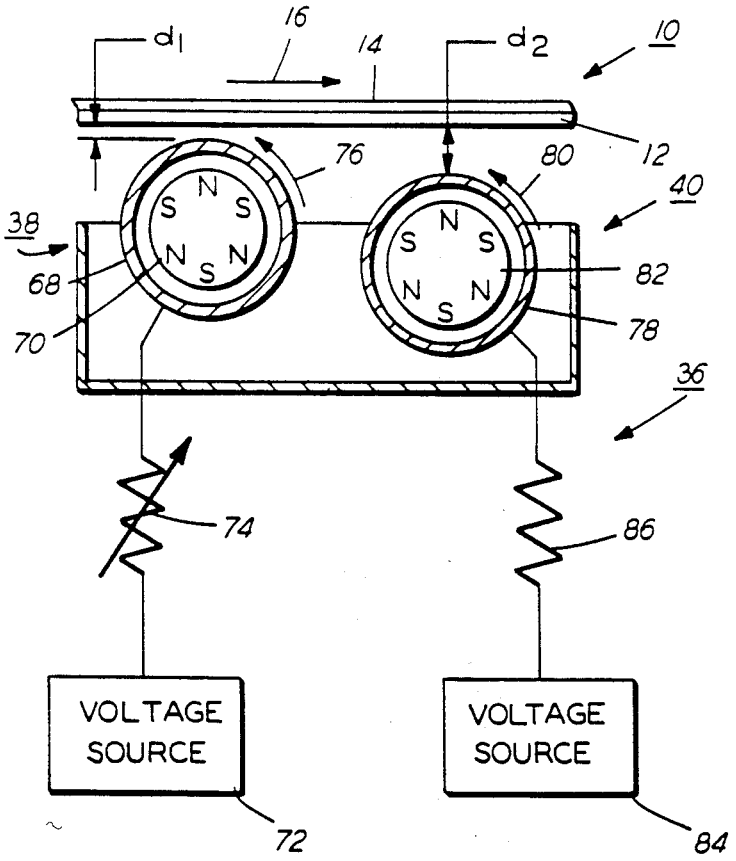

Referring now to the specific subject matter of the present invention, FIG. 2 depicts magnetic brush development system 36 in greater detail. As shown thereat, developer roller 38 includes a non-magnetic tubular member 68 journaled for rotation. Preferably, tubular member 68 is made from a electrically conductive material such as aluminum having the exterior circumferential surface thereof roughened. An elongated magnetic rod 70 is positioned concentrically within tubular member 68 being spaced from the interior surface thereof. Magnetic rod 70 has a plurality of magnetic poles impressed thereon with a magnetic field attracting the developer material to tubular member 68. By way of example, magnetic rod 70 is made from barium ferrite. Tubular member 68 is electrically biased. Voltage source 72 is connected to tubular member 68 through variable resistor 74. Variable resistor 74 may be a rheostat which is mounted on the control panel of the printing machine. In this manner, the operator may select the desired resistance and accordingly adjust the electrical bias being applied to tubular member 68. If the variable resistor 74 is adjusted such that the electrical bias applied to tubular member 68 is zero or of a low bias, developer roller 38 provides both line and solid area development of the electrostatic latent image. If variable resistor 74 is adjusted such that a reverse bias is applied to tubular member 68, developer roller 38 suppresses development of solid areas. Tubular member 68 is spaced a distance d1 from photoconductive surface 12. Preferably, d1 ranges from about 0.010 inches (0.025 centimeters) to about 0.020 inches (0.050 centimeters). This spacing insures good solid area development when tubular member 68 is electrically biased to zero or a low bias potential. Preferably, tubular member 68 is electrically biased to about 100 volts to achieve good solid area development. Alternatively, tubular member 68 may be electrically biased to about −100 volts to suppress solid area development. A motor (not shown) rotates tubular member 68 at a substantially constant angular velocity, preferably about 400 revolutions per minute in the direction of arrow 76. A brush of developer material is formed on the exterior circumferential surface of tubular member 68. As tubular member 68 rotates in the direction of arrow 76, the brush of developer material advances into contact with the latent image. The toner particles are attracted from the carrier granules to the latent image forming a toner powder image on photoconductive surface 12. Depending upon the selected electrical bias, solid area development may be achieved or suppressed.

Magnetic brush developer roller 40 includes a non-magnetic tubular member 78 journaled for rotation in the direction of arrow 80. A magnetic rod 82 is disposed concentrically within tubular member 78 being spaced from the interior surface thereof. By way of example, tubular member 78 is made preferably from an electrically conductive material such as aluminum having a roughened exterior circumferential surface. Magnetic rod 82 is made preferably from barium ferrite having a plurality of magnetic poles impressed thereon. Voltage source 84 is connected to tubular member 78 through resistor 86. Resistor 86 is selected such that the electrical bias applied to tubular member 78 is at the desired magnitude to optimize development of lines, while insuring that background is not developed. Resistor 86 may be a variable resistor. However, it is not operator controlled but is fixed depending upon the required electrical bias to achieve line development. Preferably, tubular member 78 is electrically biased to about 350 volts. Tubular member 78 is spaced a distance d2 from photoconductive surface 12. The distance d2 is greater than the distance d1 and preferably ranges from about 0.040 inches (0.10 centimeters) to 0.10 inches (0.25 centimeters). In operation, developer roller 38 provides both line and solid area development with a low electrical bias potential being applied thereto. Developer roller 40 provides line development with lesser solid area development due to the greater spacing from photoconductive surface 12. Electrostatic calculations show that line fields and fields over dots, e.g. halftones, are not significantly affected by the increased spacing, but that solid areas are greatly reduced by the large spacing. The amount of solid area development achieved by the second roll is determined by the selected spacing and the conductivity of the developer material. Suppression of solid area development, in particular, low density solids, without reduced line development, particularly low density lines, can be obtained by supplying a reverse bias to developer roller 38 which raises the development threshhold and effectively reduces both solid and line development of that developer roller. Lines and dots are still fully developed by developer roller 40. Background level is controlled primarily by the electrical bias on developer roller 40. The developer material employed should be sufficiently insulative to prevent inductive charging, it should have a resistivity of at least $10^{12}$ ohm-centimeters.

In recapitulation, the development apparatus of the present invention selectively develops or suppresses development of solid areas while optimizing line development. This is achieved by utilizing a two development roller system. The first developer roller is electrically biased to optimize solid area development or, to suppress solid area development. The second developer roller optimizes line development. Thus, depending upon the selected electrical bias, solid area development may be optimized or suppressed. It is highly desirable to suppress solid area development when the original document comprises primarily lines and/or halftones. Alternatively, high density, high contrast solid area development can be achieved when it is desired. Thus, solid area development is optimized or suppressed during the first contact time with line development being optimized during the second or last contact time.

It is, therefore, apparent that there has been provided in accordance with the present invention an apparatus for developing an electrostatic latent image that optimizes or suppresses development of solid areas while optimizing line development. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. An apparatus for developing a latent image, including:

means for transporting marking particles into contact with the latent image at least two successive times;

operator adjustable means, coupled to said transporting means, for electrically biasing said transporting means to at least either a first electrical potential substantially optimizing development of solid areas with the marking particles during the first contact time or to a second electrical potential substantially suppressing development of solid areas with the marking particles during the first contact time; and means, coupled to said transporting means, for electrically biasing said transporting means to an electrical potential substantially optimizing development of lines with the marking particles during the second contact time.

2. An apparatus according to claim 1, wherein said transporting means includes:

a first developer roller coupled to said operator adjustable electrical biasing means; and a second developer roller coupled to said electrical biasing means.

3. An apparatus according to claim 2, wherein said second developer roller is spaced from the latent image a greater distance than said first developer roller.

4. An apparatus according to claim 3, wherein:

said first developer roller includes a first non-magnetic tubular member journaled for rotary movement to transport the marking particles into contact with the latent image, and first means for attracting the marking particles to said first tubular member; and said second developer roller includes a second non-magnetic tubular member, spaced from said first non-magnetic tubular member, journaled for rotary movement to transport the marking particles into contact with the latent image, and second means for attracting the marking particles to said second tubular member.

5. An apparatus according to claim 4, wherein said operator adjustable electrical biasing means includes an operator adjustable voltage source electrically connected to said first non-magnetic tubular member.

6. An apparatus according to claim 5, wherein said electrical biasing means includes a voltage source electrically connected to said second non-magnetic member.

7. An electrophotographic printing machine of the type having an electrostatic latent image recorded on a photoconductive member, wherein improvement includes:

means for transporting marking particles into contact with the electrostatic latent image recorded on the photoconductive member at least two successive times;

operator adjustable means, coupled to said transporting means, for electrically biasing said transporting means to at least either a first electrical potential substantially optimizing development of solid areas with the marking particles during the first contact time or to a second electrical potential substantially suppressing development of solid areas with the marking particles during the first contact time; and means, coupled to said transporting means, for electrically biasing said transporting means to an electrical potential substantially optimizing development of lines with the marking particles during the second contact time.

8. A printing machine according to claim 7, wherein said transporting means includes:

a first developer roller coupled to said operator adjustable electrical biasing means; and a second developer roller coupled to said electrical biasing means.

9. A printing machine according to claim 8, wherein said second developer roller is spaced from the photoconductive member a greater distance than said first developer roller.

10. A printing machine according to claim 9, wherein:

said first developer roller includes a first non-magnetic tubular member journaled for rotary movement to transport the marking particles into contact with the electrostatic latent image recorded on the photoconductive member, and first means for attracting the marking particles to said first tubular member; and said second developer roller includes a second non-magnetic tubular member, spaced from said first non-magnetic tubular member, journaled for rotary movement to transport the marking particles into contact with the electrostatic latent image recorded on the photoconductive member, and second means for attracting the marking particles to said second tubular member.

11. A printing machine according to claim 10, wherein said operator adjustable electrical biasing means includes an operator adjustable voltage source electrically connected to said first non-magnetic tubular member.

12. A printing machine according to claim 11, wherein said electrical biasing means includes a voltage source electrically connected to said second non-magnetic member.

* * * * *